United States Patent [19]

Yang et al.

[11] Patent Number: 4,473,821

[45] Date of Patent: Sep. 25, 1984

[54] PERSONAL ACOUSTIC ALARM SYSTEM

[75] Inventors: Ta-Lun Yang, Rockville, Md.; Paul Broome, Luray, Va.

[73] Assignee: Ensco Inc., Springfield, Va.

[21] Appl. No.: 348,245

[22] Filed: Feb. 12, 1982

[51] Int. Cl.[3] ..... G08B 1/08; G10K 11/00

[52] U.S. Cl. ..... 340/539; 340/696; 340/384 R; 340/825.74; 367/197; 367/199

[58] Field of Search ..... 340/539, 696, 384 R, 340/384 E, 825.69, 825.72, 825.73, 825.74, 825.76; 367/93, 94, 197–199; 455/603, 95, 100

[56] References Cited

U.S. PATENT DOCUMENTS

| | | | |
|---|---|---|---|
| 3,696,384 | 10/1972 | Lester | 340/312 |
| 3,798,600 | 3/1974 | Saikaishi et al. | 367/199 |
| 3,805,265 | 4/1974 | Lester | 343/6.5 R |
| 3,868,639 | 2/1975 | Okada et al. | 367/197 |
| 3,970,987 | 7/1976 | Kolm | 367/197 |
| 4,063,410 | 12/1977 | Welling | 58/38 R |
| 4,075,624 | 2/1978 | Sheff | 340/384 R |
| 4,088,995 | 5/1978 | Paladino | 340/384 E |
| 4,121,198 | 10/1978 | Tsuboi et al. | 367/199 |
| 4,225,953 | 9/1980 | Simon et al. | 367/117 |
| 4,337,460 | 6/1982 | Smith et al. | 340/384 R |

*Primary Examiner*—Donnie L. Crosland

*Attorney, Agent, or Firm*—Sixbey, Friedman & Leedom

[57] ABSTRACT

The personal acoustic alarm unit produces an audible alarm signal in the audio range to alert persons in the area of the signal transmitter. This audio alarm signal is formed by a plurality of simultaneously generated audio frequency sonic signals, each of which has a different audio frequency. Receiver units are turned to receive the audio frequency sonic signals from a specific transmitter or group of transmitters.

16 Claims, 5 Drawing Figures

PERSONAL ACOUSTIC ALARM SYSTEM

TECHNICAL FIELD

The present invention relates to alarm systems generally, and more particularly to a personal alarm system adapted to operate in the audio range to provide an audio alarm signal while simultaneously providing a unique alarm signal to a central receiver system.

BACKGROUND ART

Personal alarm systems as presently developed generally fall within two categories. One category is designed to operate in the audio range and provide a loud noise to attract the attention of people in the vicinity who might provide aid and, in some instances, to surprise an attacker. The other type of personal alarm system is the silent alarm which provides no audible signal in the vicinity of the alarm transmitter. Systems of this type generally employ radio signals which are picked up by receivers installed in a protected area, and these systems transmit some type of identification code unique to the transmitter.

Both types of known personal alarm systems are subject to a number of disadvantages. The strictly audio alarm transmitter is in effect useless if there are no people within the range of the audio signal produced. Additionally, strictly audio alarm units are often ineffective in areas of high noise level, and the audio signal may be masked by other audio signals of the same frequency and amplitude. On the other hand, totally silent alarms employing radio frequencies or frequencies beyond the audio range have no deterrent effect upon an attacker and fail to attract the attention of persons within the range of the audio signal who may provide a source of immediate aid. Additionally, radio signals can often be jammed, or spurious radio frequencies in an area can cause a receiver system to provide false alarms.

In any high risk situation, such as those existent in prisons, mental institutions, and public areas such as parking lots and college campuses, as well as in institutions and areas where persons require emergency care, a great need exists for a personal alarm system which is operable in the audio range and is effective to summon aid from the immediate vicinity of the alarm transmitter as well as providing the capability of summoning aid through the means of a central receiver system. Any alarm system operable in the audio range must be designed to effectively eliminate the probability of false alarms being generated by other audio signals in the vicinity, and must also be designed to prevent unauthorized use of the signal generator to defeat the alarm system by triggering repeated false alarms.

DISCLOSURE OF THE INVENTION

It is a primary object of the present invention to provide a novel and improved acoustic alarm system operable in the audio range to simultaneously provide an audio alarm signal in the vicinity of an alarm transmitter as well as a unique alarm signal to a central receiver system. The audio signal produced by the alarm transmitter is unique to a specific central receiver system and will not be operable with other receiver systems tuned to other audio alarm transmitters.

Another object of the present invention is to provide a novel personal acoustic alarm system including a transmitter for providing an audible alarm signal in the audio range. This audio signal is formed by a plurality of different audio frequencies which are simultaneously transmitted to provide a unique acoustic signal. This unique acoustic signal may be received by a plurality of receivers for a central receiver system, such receivers being tuned to receive a specific multi-frequency signal. However, such signal is unique to one or more transmitters adapted to be employed with a particular receiver network, and will not operate with other audio receiver systems. A receiver tuned to a unique multi-frequency audio signal will not be subject to false alarms caused by audio signals having one of such frequencies which occur in the vicinity of the transmitter.

A further object of the present invention is to provide a novel personal acoustic alarm system including a minature portable transmitter for producing an audible alarm signal in the audio frequency range. This audible alarm signal is formed by a plurality of different audio frequencies simultaneously transmitted, and additionally one or more of these audio frequencies includes a time pulse code pattern or other code to identify the specific transmitter. This code pattern may be repeated a number of times to increase the likelihood of detection, but after the code has been transmitted the requisite number of times in a single transmission, the code in the transmitter is destroyed. Once the code is used, the transmitter must be reprogrammed with a new code.

Another object of the present invention is to provide a personal acoustic alarm system including one or more portable transmitters for providing an audible alarm in the acoustic range by transmitting a sonic signal including a combination of distinct audio frequencies emitted simultaneously. The system includes a receiver mounted in a fixed location for monitoring the acoustic signals in an area, the receiver being designed to recognize an acoustic signal containing a specific group of audio frequencies. The receiver will then provide an alarm indication and re-set back to a monitoring mode after handling each alarm call. The detection level in the receiver is adjustable for the purpose of controlling the receiver range of effectiveness.

A still further object of the present invention is to provide a personal acoustic alarm system including a transmitter which emits a sonic signal in the audible range including a plurality of unique audio frequencies which serve to adapt the transmitter for use with only a specific sonic receiver system.

Other objects and advantages of this invention will become apparent to those skilled in the art from a consideration of the following specification and claims taken in conjunction with the accompanying drawings.

More specifically, in accordance with the aforesaid objects, the present invention provides a personal acoustic alarm system having a minature portable transmitter containing its own power source. When activated by a user, the transmitter will sound an audible alarm in the audio frequency range for a fixed duration or until the power supply is exhausted. This audible alarm is an acoustic signal composed of a group of different unique audio frequencies which are adapted to be received by a specific receiver system. Thus a transmitter adapted for use with one receiver system will not cause an alarm in the receiver system for a similar personal acoustic alarm system in the same area. Additionally, the acoustic signal transmitted by any transmitter may be pulse coded with a time pulse pattern or other code to identify the specific transmitter providing the alarm. Once the alarm signal is generated and repeated for a desired number of times, the code in the transmitter is destroyed to prevent persons from rendering the alarm system ineffective by triggering repeated false alarms. The code can be replaced or reprogrammed so that the transmitter may then be reused.

BEST MODE FOR CARRYING OUT THE INVENTION

Figure 1:
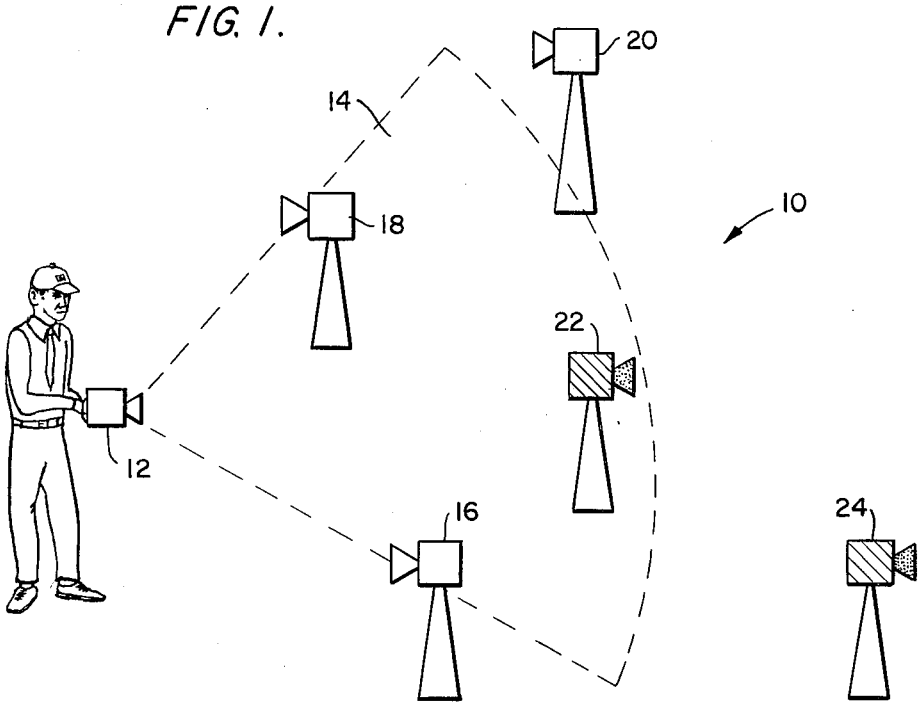
FIG. 1 is a diagrammatic view showing the arrangement of a personal acoustic alarm system of the present invention.

Referring now to FIG. 1, the personal acoustic alarm system of the present invention indicated generally at 10 consists of a transmitter 12 which may be triggered to produce an audible alarm signal. This signal is in the audio range and consequently may be heard by persons within the area 14 where the signal is audible. Also, the signal is picked up by receivers 16 and 18 which are within the audible range 14 of the signal. A receiver 20, which is connected in the same receiver system with the receivers 16 and 18, does not pick up the signal from the transmitter 12, as this receiver is beyond the audible range 14. Also, a receiver 22, which is within the audible range 14, does not receive the signal from the transmitter 12, as the receiver 22 is part of a separate receiver system which, with the receiver 24, is tuned to different transmitter frequencies. This is extremely important, for often it may be necessary to employ two personal acoustic alarm systems in the same area without having the transmitters for one system trigger the receivers of the other. For example, the receiver system 16, 18 and 20 of FIG. 1 might be placed on an area, such as a college campus, which is adajcent to the parking lot for a bank. The receivers 22 and 24 may be positioned in the bank parking lot, with some of these receivers being within the audio range of the receivers 16,18 and 20. Consequently, it is imperative that persons on the college campus provided with transmitters 12 not be able to interfere with the reception of signals by the bank recivers 22 and 24, nor should these persons be able to trigger an alarm indication in the bank receivers. Therefore, in accordance with this invention, the receivers for each personal acoustic alarm system are specifically tuned to the transmitters employed for that system, and these transmitters will not provide a signal which will be received by another receiver system.

Figure 2:
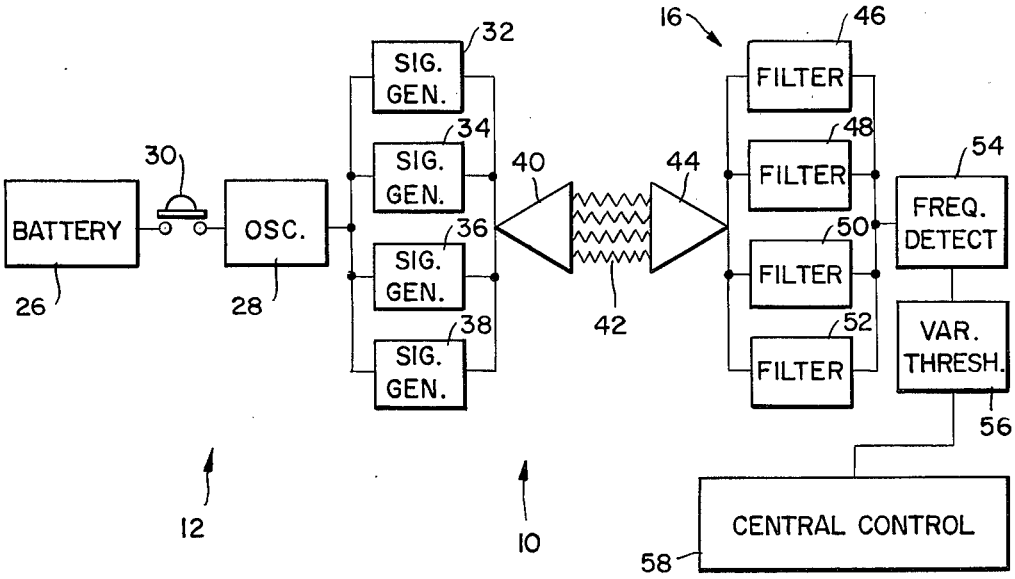
FIG. 2 is a block diagram of a transmitter and receiver for the personal acoustic alarm system of the present invention.

Referring now to FIG. 2, the transmitter 12 in its simplest form includes a power supply 26 formed by a suitable battery. This power supply may be connected to an audio frequency oscillator 28 by the closure of a switch 30. When the oscillator is energized from the battery 26, an audio frequency signal is provided to a plurality of audio signal generators 32,34,36 and 38. Upon receipt of an audio base frequency from the oscillator 28, each of the signal generators provides an output audio signal of a unique frequency to an audio transmission device 40 which might constitute a speaker, a horn, a siren or other device capable of transmitting a signal containing the four distinct audio frequencies generated by the signal generators. Thus, the audio output 42 from the audio transmission device contains four different distinct frequencies. Although, for purposes of description, four signal generators and four frequencies have been employed relative to the transmitter 12 of FIG. 2, it must be understood that any number of frequencies may be used as long as there are a plurality of audio frequencies. This is required to prevent spurious sounds in the transmission area 14 from triggering false alarms in the receivers for the personal acoustic alarm system 10. For example, a car horn might produce one of the audio frequencies contained in the signal 42, but it is very unlikely that all four audio frequencies would occur simultaneously in the area 14 to trigger a false alarm.

In FIG. 2, the receiver 16 of FIG. 1 is illustrated, although it must be recognized that each of the receivers in the personal acoustic alarm system 10 is identical in construction. The receiver 16 includes an audio signal pick up device 44, which may constitute a microphone or similar audio receiver, and this pick up device transmits the audio signal 42 to filters 46,48,50 and 52. These filters are tuned to pass the frequencies generated by the signal generators 32,34,36 and 38, and to block all other audio frequencies received by the pick up device 44. The output from the filters 46,48,50 and 52 is fed to a frequency detector 54 which detects if all four frequencies are present. If one or more of the transmitted frequencies are missing, no output signal is provided by the frequency detector 54, but if all four audio frequencies transmitted by the transmitter 12 are received, the frequency detector provides a signal through a variable threshold circuit 56 to a central control unit 58. The variable threshold circuit 56 may be adjusted to set the range of the receiver 16, so that signals from a transmitter 12 which occur within a certain distance from the receiver are always received by that receiver. Each transmitter 12 employed in the personal acoustic alarm system 10 produces an output signal of equal strength, but the individual receiver units may be tuned to different ranges.

The central control unit 58 may operate upon receipt of a signal from the variable threshold unit 56 to provide some alarm action, such as sounding a siren, turning on a strobe light, or dialing a telephone number.

The transmitter 12 of FIG. 2 provides an acoustic alarm signal 42 which merely identifies the personal alarm system 10 with which the transmitter is intended for use. The transmitter does not provide a signal which identifies the person employing the transmitter, and in some instances this is a very desirable feature. For example, in a prison situation, it may be important to identify the specific guard or other person associated with a specific transmitter. Additionally, if a transmitter is stolen, a code unique to that transmitter will indicate that unauthorized use of the transmitter is being made to create an alarm situation. To further prevent the unauthorized use of transmitters to trigger false or fraudulent alarms, it is also often desirable to limit the transmitter to only one transmission, and to require the transmitter to be either reprogrammed or otherwise reactivated after each transmission.

Figure 3:
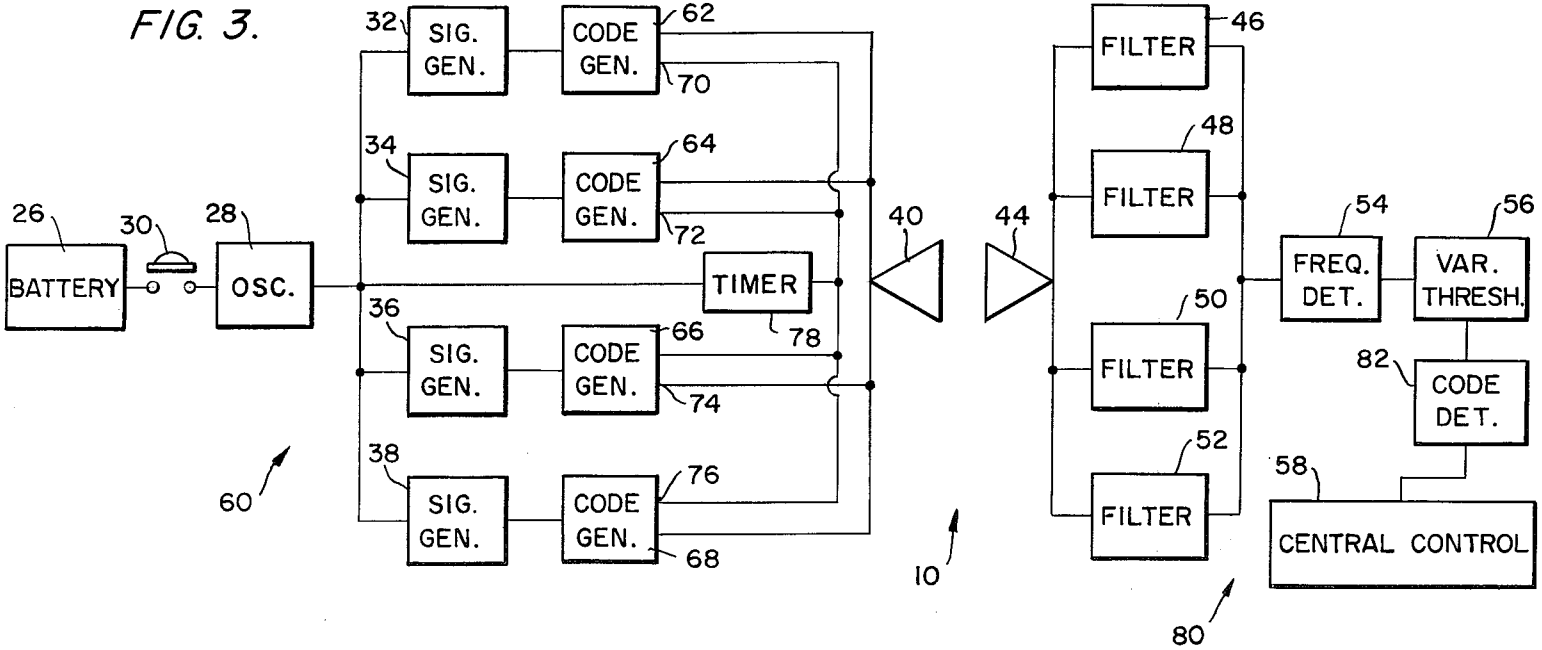
FIG. 3 is a block diagram of a second embodiment of the transmitter and receiver system for the personal acoustic alarm system of the present invention.

Referring to FIG. 3, the personal audio alarm system 10 of the present invention has been provided with a coded transmitter 60. This transmitter includes the battery power source 26, the activating switch 30, and the audio oscillator 28 of the transmitter 12, and these units provide the same function as previously described. Also, the audio oscillator 28 may be used to feed the signal generators 32,34,36 and 38 which were employed with the transmitter 12. However, these signal generators provide output signals of different audio frequencies to code generators 62,64,66 and 68. These code generators may be of a number of known forms, but the purpose of each code generator is to modulate the output from the associated signal generator with a unique code. In some instances, the code generators 62,64,66 and 68 may be programmable encoder chips of a known type wherein appropriate cuts in the data lead inputs to the generator are used to set the desired binary Manchester code which will be output to the unit 40. Such programmable coded encoders are manufactured by Supertex, Inc. of Sunnyvale, Cailf. under the designations ED-9 or ED-15. Once the audio frequency signals from the signal generators are encoded in the code generators, the four separate audio frequencies which are uniquely encoded are fed to the transmission unit 40.

As previously indicated, it may be desirable to deactivate the transmitter 60 after a single use, and for this purpose, the code generators 62,64,66 and 68 might constitute read only memory chips (ROM) in which the desired code is stored. In some instances, these read only memory chips might also store the desired audio frequency, and in such cases, the signal generators 32,34,36 and 38 can be eliminated. Each of the read only memory chips include reset or erase teminals 70,72,74 and 76 which, when provided with a pulse, destroy the code programmed in the chip. To accomplish this destruction, the oscillator 28 also provides a signal to a timer 78. Thus, when the transmitter 60 has provided an audible output alarm signal for a desired time, the timer will provide an output pulse to the erase terminals 70,72,74 and 76 which will destroy the code programmed in the code generators 62,64,66 and 68. To then reuse the transmitter 60, it is necessary to take the transmitter to a central location and have the code generators reprogrammed.

The transmitter 60 is adapted for use with a receiver 80 which, like the receiver 16, includes an acoustic signal pick up unit 44 and filters 46, 48,50 and 52 tuned to the frequencies of the signal generators 32,34,36 and 38. If these frequencies are present in the audio alarm signal 42, they are passed to the frequency detector 54. The frequency detector will detect if all four frequencies are present, and if so, pass these frequencies through the variable threshold unit 56 which outputs the four coded frequencies to a code detector 82. The code detector identifies the code which the code generators 62,64,66 and 68 have encoded on the audio signal 42, and the output of the code detector is sent to the central control unit 58. At the central control unit an alarm indication is triggered, and the identity of the transmitter is recorded and indicated. If no code is detected by the code detector, such as in cases where the transmitter has been previously used, no signal will be sent to the central control unit.

Figure 4:
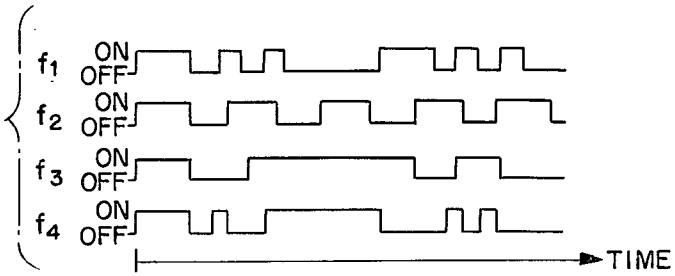
FIG. 4 is a diagram illustrating the acoustic frequency signals produced by the transmitter of the acoustic alarm system of the present invention.

FIG. 4 provides illustrative audio frequency waveforms of the type which might be provided by the code generators 62,64,66 and 68. As will be noted from FIG. 4, each of the waveforms is of a different audio frequency and is time coded for transmitter identification.

Figure 5:
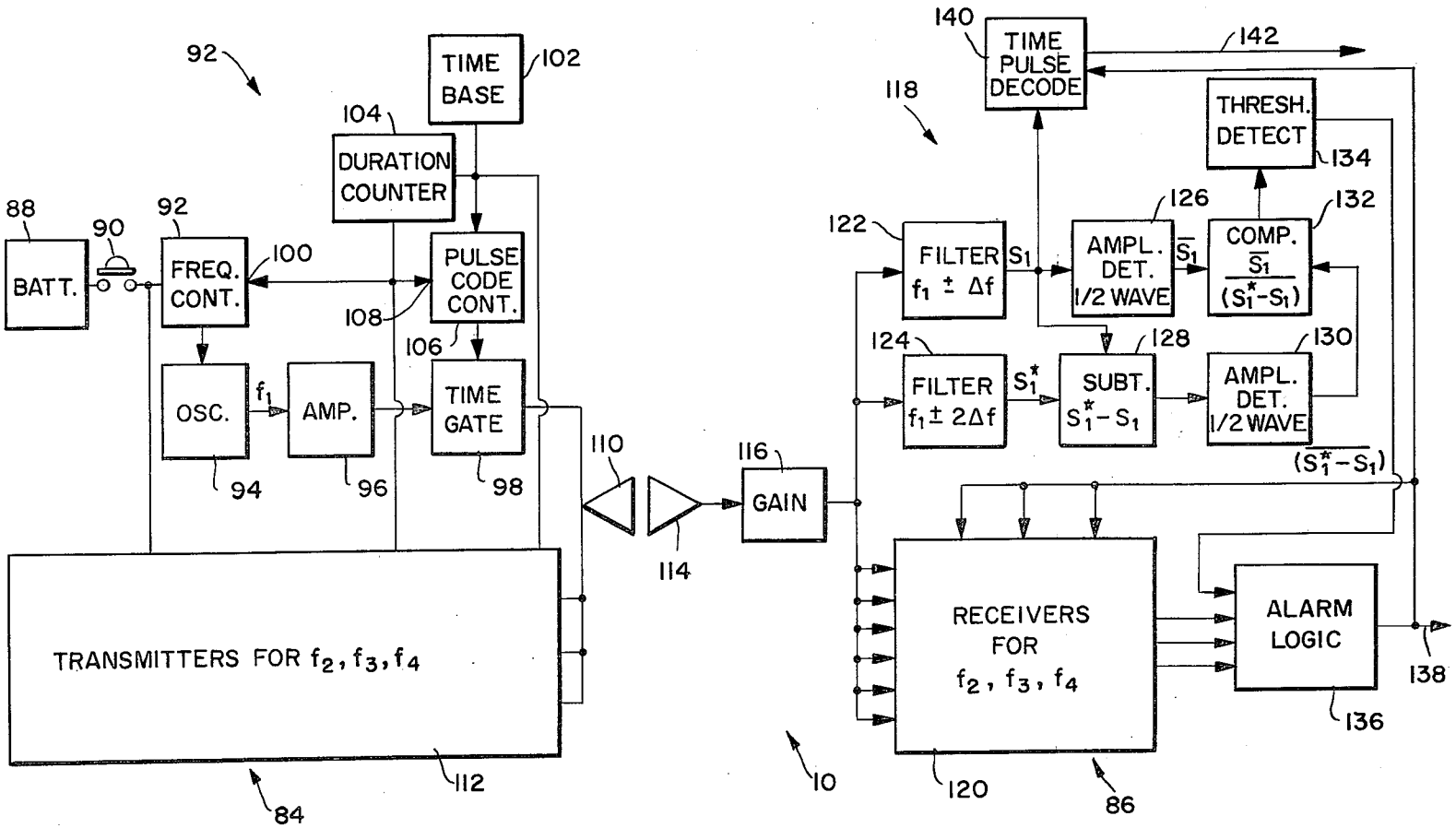
FIG. 5 is a block diagram of a third embodiment of the transmitter and receiver system for the personal acoustic alarm system of the present invention.

FIG. 5 shows a personal acoustic alarm system 10 for providing the time coded audio frequency waveforms of FIG. 4 which employs a modified transmitter 84 and receiver 86. The transmitter 84 is powered by a battery 88 which energizes the transmitter when a switch 90 is closed. Power from the battery is provided across the switch 90 to a plurality of transmitter sections, one of which indicated at 92 is disclosed in detail. When the switch 90 is closed, a frequency control module 92 causes a variable frequency audio oscillator 94 to provide an audio output frequency f1 to an amplifier 96 and a time gate 98. The frequency f1 is one of the plurality of audio base frequencies provided by the transmitter 84, and this frequency is programmed into the frequency control unit 92. As previously described, the frequency control unit may consitute a read only memory chip having the desired base audio frequency programmed therein, and this chip may include a reset or erase terminal 100 so that the program in the chip can be destroyed by an erase pulse.

Closure of the switch 90 also energizes a time base generator 102 which provides output pulses to both a duration counter 104 and a pulse code controller 106. The pulse code controller may constitute another read only memory chip having a time code programmed therein, and this chip also includes an erase or reset terminal 108 so that the stored code can be erased. The output code from the pulse code controller 106 controls the operation of the time gate 98 so that the pulse code is modulated onto the base frequency f1 from the amplifier 96. This coded output frequency is then fed from the time gate 98 to an audio transmission device 110 which is the same as the audio transmission device 40. Thus, the transmitter section 92 produces one time coded audio frequency signal corresponding to the signal f1 in FIG. 4. The signals f2, f3 and f4 are produced in transmitter sections 112 which are identical in structure to the transmitter section 92. Each of the transmitter secions 112 includes a frequency controller 92 and a pulse code controller 106 which are programmed to a frequency and pulse code which differs from that in the other transmitter sections.

Each of the transmitter section 112 may include a separate time base generator 102 and duration counter 104, or, as illustrated in FIG. 5, all of the transmitter sections for the transmitter 84 may operate from a single time base generator and duration counter. The time base generator 102 provides constant frequency pulses to the pulse code controller for each transmitter section as well as constant frequency pulses to the duration counter. After a predetermined time or duration, the duration counter 104 provides an output pulse to the reset or erase terminals 100 for the frequency controller 92 and 108 for the pulse code controller 106. This destroys or erases the programmed frequency in the frequency controller and the programmed pulse code in the pulse code controller. When a single duration counter 104 is employed, the output from this duration counter provides the erase or reset pulse to the frequency controller and pulse code controller in each of the transmitter sections.

In some instances, the transmitter 84 might not include the pulse coder 106 or the time gate 108, but instead may provide only a unique multi-frequency output which is not coded to identify the user of the transmitter. In this case, the duration counter 104 would provide an erase pulse to only the erase terminal 100 of the frequency controller 92, and therefore would destroy the programmed frequency after a specific duration of transmitter use.

The four audio frequencies f1, f2, f3 and f4 from the transmitter 84 are simultaneously transmitted from the audio transmission device 110 to an audio signal pickup device 114 which corresponds to the pickup device 44. The received signal from the pickup device 114 passes through a variable gain unit 116 which is employed to preset the gain of the receiver 86 and thus the distance to a transmitter 84 within which the receiver will be effective. The output signal from the variable gain unit is then sent to separate, identical receiver sections, one of which is provided for each received frequency. One of such receiver sections for the frequency f1 is shown in detail at 118, while identical receiver sections for the frequencies f2, f3 and f4 are indicated by the block 120. The receiver section 118 includes two input band pass filters 122 and 124 which are tuned to operate with the frequency f1. The band pass filter 122 is a narrow band pass filter while the filter 124 is a wide band pass filter. Thus the output $S_1$ from the narrow band pass filter 122 is indicative of a band of frequencies close to the center range of the frequency f1, while the output $S_1$* from the wide band pass filter 124 is indicative of a wider range of frequencies on either side of this center range. The output from the narrow band pass filter 122 is passed to a one-half wave amplitude time averaging detector 126 which detects the amplitude of the signal f1 in the center range of frequencies. Simultaneously, the wide band pass filter output is provided to a subtractor 128 which subtracts the signal $S_1$ from the signal $S_1$* to provide an output signal in the band next to the center frequency band output from the filter 122. This signal is then fed to a half wave amplitude time average detector 130 which will detect the amplitude of the signal f1 appearing in this band. The output of the detector 130 and the output of the detector 126 are then fed to a comparator 132 which compares the signals from the two detectors and provides a resultant output signal which is then fed to a threshold detector 134. The threshold detector detects if a signal of the frequency f1 of a proper amplitude is present in the received signal. If this is the case, the threshold detector provides an output to an alarm logic system 136 which, in effect detects the presence of all the necessary frequencies f1, f2, f3 and f4 in the received signal. If the alarm logic system 136 also receives signals from the receiver sections 120 to indicate the presence of received frequency signals f2, f3 and f4 of the proper amplitude, the alarm logic system will provide an output signal on a terminal 138 which is then transmitted to an appropriate central indicator and monitor such as the central control system 58 of FIG. 3. Also, the output from the alarm logic system 136 is provided to activate a time pulse decoder 140 which senses the time code modulated upon the base frequency f1. The output from the time pulse decoder is then provided to a terminal 142 for transmission to an appropriate monitoring device and indicator, such as the central control system 58. If the four frequency audio signal transmitted by the transmitter 84 does not include a time pulse code, then the time pulse coder 140 will provide no output to the terminal 142.

In connection with the description of the foregoing embodiments of the personal acoustic alarm system 10 of the present invention, it has been indicated that the plurality of frequencies forming the audio signal transmitted by the alarm transmitter would indicate the receiver system with which the transmitter is to be used while the time base code will identify the user of the transmitter. Obviously, any other combination of these elements may be used for identifying purposes. For example, the plurality of audio frequencies from the transmitter may identify the user of the transmitter, and may differ for each individual transmitter in the system, while each transmitter used in a particular system could employ the same time pulse code so that only transmitters with this time pulse code could be used with the receivers of the system.

INDUSTRIAL APPLICABILITY

The personal acoustic alarm system 10 may be employed in prisons, mental institutions, or public areas such as parking lots and campuses to provide an alarm for a person subjected to a high risk situation. Conversely, the system is also readily adapted to household use for monitoring a patient or invalid. The alarm system using the acoustic transmitters and receivers may consist of a single pair of receiver and transmitter, such as would be used in a household monitoring system, or may include a network of receivers serving many transmitters, such as would be required on a university campus.

We claim:

1. A personal acoustic alarm unit for providing an audible alarm signal in the audio range comprising a transmitter means including signal generating means for simultaneously generating a plurality of individual sonic signals in the audio frequency range, each such sonic signal having an audio frequency which differs from that of the remaining sonic signals, code generator means connected to receive at least one of said individual sonic signals and operating to apply a unique code thereto, and means for transmitting said sonic signals simultaneously as an audible alarm signal.

2. The personal acoustic alarm unit of claim 1 wherein said transmitter means includes timing means operative upon activation of said transmitter means to initiate a predetermined time period, said code generator means having said unique code programmed therein and being operative upon receipt of an erase signal to destroy said programmed unique code, said timing means operating at the termination of said predetermined time period to provide an erase signal to said code generator means.

3. The personal acoustic alarm unit of claim 2 wherein said signal generating means includes frequency program means having the audio frequencies for said sonic signals programmed therein, said frequency program means operating to remove the audio frequencies programmed therein in response to said terminate signal, and said code generator means includes code program means having said unique code programmed therein, said code program means operating to remove the unique code programmed therein in response to said terminate signal.

4. A personal acoustic alarm system for providing an audible signal in the event a user requires aid and for use in areas where signals which might trigger false alarms may occur, comprising:

alarm transmitter means specifically associated with the personal acoustic alarm system for simultaneously emitting a plurality of distinct audible alarm signals all of which are unique to said alarm transmitting means, said audible alarm signals providing a substantial audible alarm adjacent to said alarm transmitter means while also being transmitted to locations spaced from said alarm transmitter means; and a signal receiving means associated with said alarm transmitter means for receiving said distinct audible alarm signals and having filter means for blocking signals emitted by a transmitter means not specifically associated with the personal acoustic alarm system for preventing false alarms, and an alarm activating means connected to said filter means for receiving signals passed through said filter and for providing alarm action only when a plurality of said distinct audible alarm signals are passed through said filter means whereby only the audible alarm signals emitted by and unique to said alarm transmitter means cause alarm action.

5. The personal acoustic alarm system of claim 4 wherein said transmitter means includes code generator means for applying a unique code to at least one of said distinct audible alarm signals.

6. The personal acoustic alarm system of claim 5 wherein said signal receiving means includes decoder means connected to sense the presence of said unique code.

7. The personal acoustic alarm of claim 5 wherein said transmitter means further includes timing means operative upon activation of said transmitter means to initiate a predetermined time period, said code generator means having said unique code programmed therein and being operative upon receipt of an erase signal to destroy said programmed unique code, said timing means operating at the termination of said predetermined time period to provide an erase signal to said code generator means.

8. The personal acoustic alarm system of claim 4, further including a plurality of audio signal generator means each generating one of said distinct audible alarm signals and an audio frequency oscillator connected to said plurality of audio signal generator means.

9. The personal acoustic alarm system of claim 8 wherein said transmitter means includes timing means operative upon activation of said transmitter means to initiate a predetermined time period, said timing means operating at the termination of said predetermined time period to provide a terminate signal, said signal generator means being connected to receive said terminate signal and operating upon receipt thereof to terminate the generation of said plurality of alarm signals.

10. The personal acoustic alarm system of claim 9 wherein said transmitter means includes code generator means for generating and applying a unique code to at least one of said individual audible alarm signals, said code generator means being connected to receive said terminate signal and operating upon receipt thereof to terminate the generation of said unique code.

11. The personal acoustic alarm system of claim 10 wherein said signal generating means includes frequency program means having the audio frequencies for said audible alarm signals programmed therein, said frequency program means operating to remove the audio frequencies programmed therein in response to said terminate signal, and said code generator means includes code program means having said unique code programmed therein, said code program means operating to remove the unique code programmed therein in response to said terminate signal.

12. The personal acoustic alarm system of claim 4 wherein said receiving means includes range control means to vary the range of said receiver means.

13. The personal acoustic alarm system of claim 4 wherein said filter means includes a plurality of filters each being tuned to pass a specific one of the plurality of distinct audible alarm signals.

14. The personal acoustic alarm system of claim 13, wherein said signal receiving means further includes a frequency detector means connected to said plurality of filters for preventing actuation of said alarm activating means unless all of said plurality of audible alarm signal are present in a signal received by said signal receiving means.

15. The personal acoustic alarm system of claim 14, wherein said receiving means further includes a variable threshold circuit means connected to said frequency detector means for setting a range of sensitivity for said receiving means.

16. A personal acoustic alarm system for providing an audible signal in the event a user requires aid and for use in areas where signals which might trigger false alarms may occur, comprising:

an alarm transmitter means specifically associated with the personal acoustic alarm system for simultaneously emitting a plurality of audible alarm signals each having a substantially constant frequency which differs from the frequency of the remaining alarm signals, said audible alarm signals being unique to said alarm transmitting means and providing a noise alarm adjacent to said alarm transmitter means while also being transmitted to locations spaced from said alarm transmitter means; a signal receiving means associated with said alarm transmitter means for receiving said different constant frequency signals and for blocking signals having frequencies different from those signals emitted by said alarm transmitter means; and an alarm means connected for activation by said signal receiving means for providing alarm action whereby only the audible alarm signals emitted by and unique to said alarm transmitter means causes alarm action.

* * * * *